US006275672B1

(12) United States Patent
Blum et al.

(10) Patent No.: US 6,275,672 B1
(45) Date of Patent: Aug. 14, 2001

(54) ADJUSTMENT MECHANISM FOR DEVELOPMENT STATION ELEMENTS

(75) Inventors: James George Blum, Livonia; Kenneth Joseph Brown, Penfield; Christopher Stephen Garcia; Donald Steven Hensel, both of Rochester; Gary Edwin Nichols, Fairport; Paul Essic Thompson, Webster, all of NY (US)

(73) Assignee: NexPress Solutions LLC, Rochester, NY (US)

( * ) Notice: Subject to any disclaimer, the term of this patent is extended or adjusted under 35 U.S.C. 154(b) by 0 days.

(21) Appl. No.: 09/442,303

(22) Filed: Nov. 19, 1999

(51) Int. Cl.[7] ..... G03G 21/16; G03G 15/06
(52) U.S. Cl. ..... 399/126; 399/222
(58) Field of Search ..... 399/222, 119, 399/126, 267

(56) References Cited

U.S. PATENT DOCUMENTS 3,999,514 * 12/1976 Abbott et al. ..... 399/267 X
4,292,922 * 10/1981 Yamazaki et al. ..... 399/267 X
5,640,229 * 6/1997 Nakahara ..... 399/119

* cited by examiner

*Primary Examiner*—Susan S. Y. Lee
(74) *Attorney, Agent, or Firm*—Lawrence P. Kessle

(57) ABSTRACT

A mechanism for adjusting the location of a rotatable mixer and rotatable transport mechanism within the development station housing of an electrographic reproduction apparatus development station. The development station includes a housing, a rotatable mixer assembly located in a developer material reservoir within the housing, a developer device for applying developer material to an electrostatic image to be developed, a rotatable transport mechanism for moving developer material from the reservoir to the developer device, and a drive mechanism for rotating the rotatable mixer, the rotatable transport mechanism, and the developer device. The adjustment mechanism describes a first locating device for adjustably positioning the drive mechanism relative to the reservoir of the development station housing, and a second locating device for adjustably positioning the rotatable mixer and the rotatable transport mechanism relative to the development station housing. The second locating device includes a spacer member for maintaining a predetermined fixed distance between the rotatable mixer and the rotatable transport mechanism.

18 Claims, 7 Drawing Sheets

ADJUSTMENT MECHANISM FOR DEVELOPMENT STATION ELEMENTS

FIELD OF THE INVENTION

This invention relates in general to magnetic brush development stations for electrographic reproduction apparatus, and more particularly to a mechanism for adjusting the relationship between elements of a magnetic brush development station and the development station housing wall.

BACKGROUND OF THE INVENTION

In typical commercial electrographic reproduction apparatus (copier/duplicators, printers, or the like), a latent image charge pattern is formed on a uniformly charged charge-retentive or photoconductive member having dielectric characteristics (hereinafter referred to as the dielectric support member). Pigmented marking particles are attracted to the latent image charge pattern to develop such image on the dielectric support member. A receiver member, such as a sheet of paper, transparency or other medium, is then brought into contact with the dielectric support member, and an electric field applied to transfer the marking particle developed image to the receiver member from the dielectric support member. After transfer, the receiver member bearing the transferred image is transported away from the dielectric support member, and the image is fixed (fused) to the receiver member by heat and pressure to form a permanent reproduction thereon.

One type of development station commonly utilized in electrostatographic reproduction apparatus is the magnetic brush development station. The magnetic brush development station includes a housing containing a plurality of elements and providing a reservoir for a supply of developer material. The developer material may be, for example, a two-component material comprising magnetic carrier particles and relatively smaller pigmented marking particles. Included in the elements of the development station, a mixer assembly, such as a paddle wheel, auger, or ribbon blender, is located in the reservoir and serves to stir the carrier particles and marking particles to triboelectrically charge the particles so that the marking particles adhere to the surface of the carrier particles. A transport mechanism brings the developer material from the reservoir into the field of a plurality of magnets within a rotating sleeve, commonly referred to as the toning roller (of course, the magnets could rotate and the sleeve remain stationary or rotate with a different angular velocity from the magnets). The rotating sleeve and magnetic fields cause the marking particles to be brought into the vicinity of the latent image charge patterns on the dielectric support member to be applied to the latent image charge patterns in order to develop such patterns (see, for example, U.S. Pat. No. 4,887,132, issued Dec. 12,1989, in the names of Joseph et al).

It has been found that in manufacturing development stations of the above described type, it is difficult to obtain the desired distance (or gap) between the mixer assembly and the interior surface of the development station reservoir wall to get to the desired mixing performance. Further, it is difficult to keep the drive shaft for the mixer assembly and the drive shaft of the transport mechanism parallel to each other at final set-up. Both shafts are positioned and driven by a common gearbox. During initial set up, this gearbox is located relative to the development station housing by pins that substantially prevent horizontal or vertical movement therebetween. With the present achievable manufacturing variation and tolerances of the various elements and assemblies, the specified distance between the mixer assembly and the interior of the development station reservoir wall has not been readily obtainable or predictable. The mixer assembly and transport mechanism are positioned and secured to the development station housing by screws and are not held to a close position tolerance. Therefore, it has been impossible to keep the shafts of the mixer assembly and the transport mechanism parallel to each other.

SUMMARY OF THE INVENTION

In view of the above, this invention is directed to a mechanism for adjusting the relationship between elements of a magnetic brush development station and the development station housing wall. Accordingly, this invention provides a mechanism for adjusting the location of a rotatable mixer and rotatable transport mechanism within the development station housing of an electrographic reproduction apparatus development station. The development station includes a housing, a rotatable mixer assembly located in a developer material reservoir within the housing, a developer device for applying developer material to an electrostatic image to be developed, a rotatable transport mechanism for moving developer material from the reservoir to the developer device, and a drive mechanism for rotating the rotatable mixer, the rotatable transport mechanism, and the developer device. The adjustment mechanism describes a first locating device for adjustably positioning the drive mechanism relative to the reservoir of the development station housing, and a second locating device for adjustably positioning the rotatable mixer and the rotatable transport mechanism relative to the development station housing. The second locating device includes a spacer member for maintaining a predetermined fixed distance between the rotatable mixer and the rotatable transport mechanism.

The invention, and its objects and advantages, will become more apparent in the detailed description of the preferred embodiment presented below.

BRIEF DESCRIPTION OF THE DRAWINGS

In the detailed description of the preferred embodiment of the invention presented below, reference is made to the accompanying drawings, in which.

DETAILED DESCRIPTION OF THE INVENTION

Figure 1:
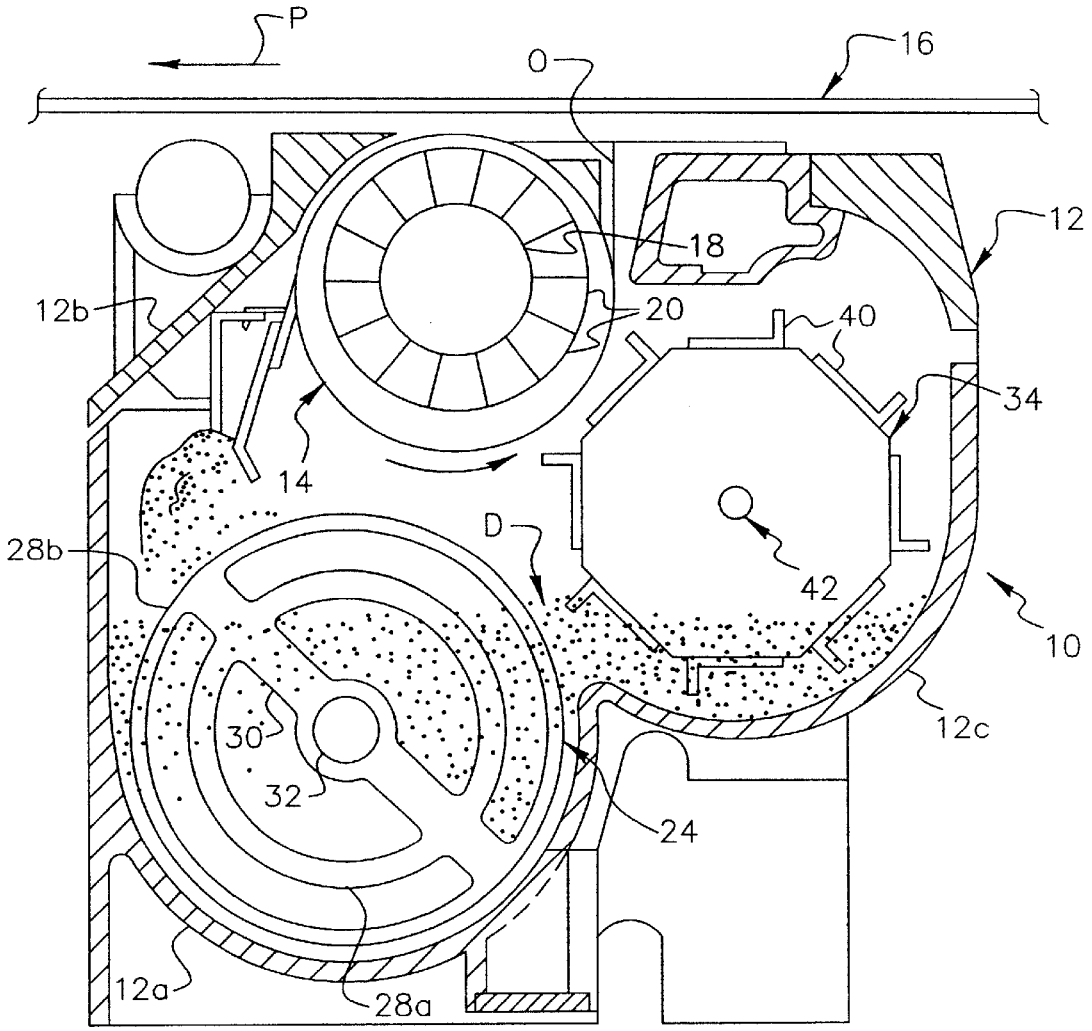
FIG. 1 is a side elevational view, partly in cross-section, of an electrographic reproduction apparatus magnetic brush development station, with portions removed or broken away to facilitate viewing.
Figure 2:
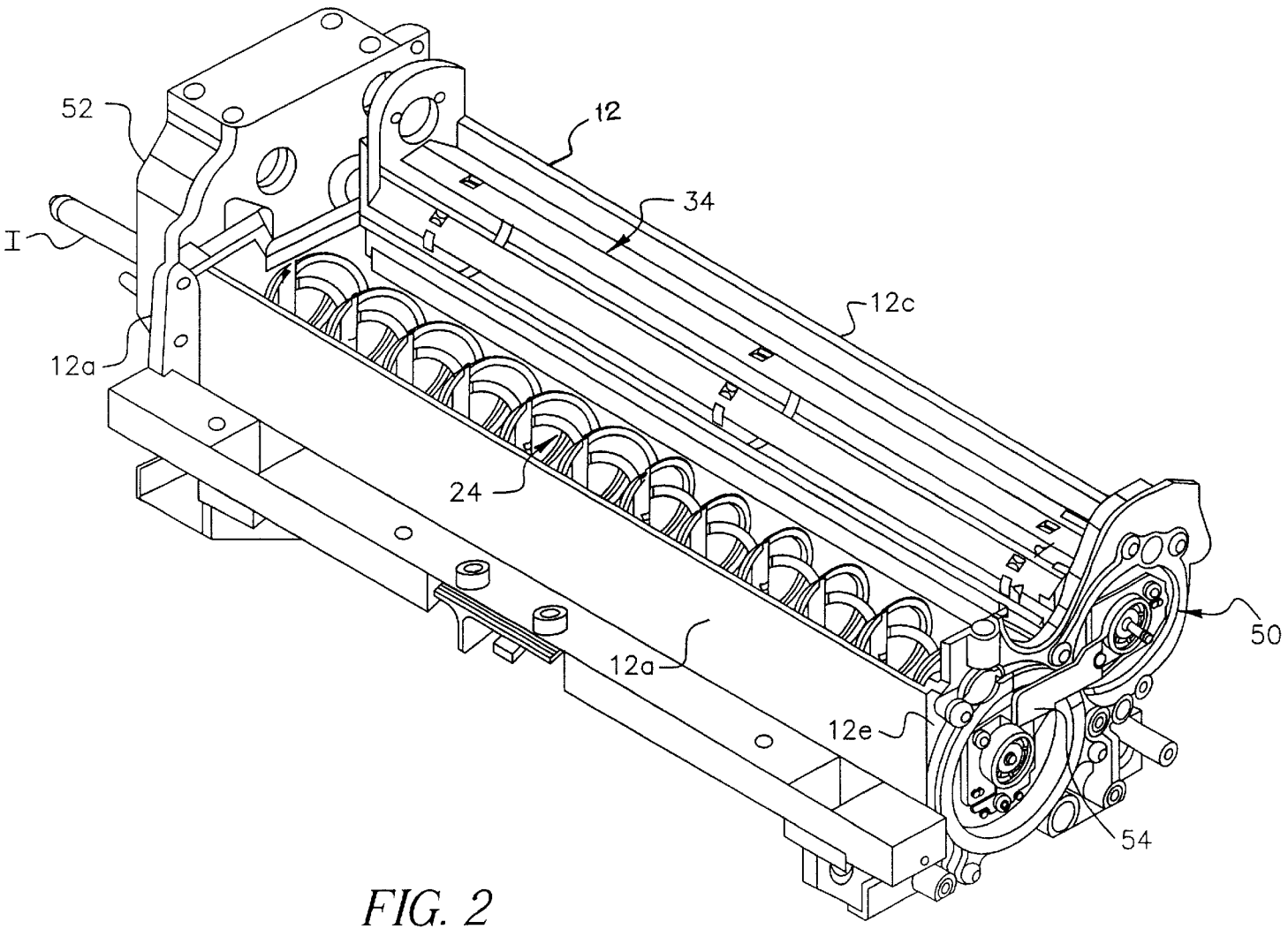
FIG. 2 is a view, in perspective, of an electrographic reproduction apparatus magnetic brush development station, including the adjustment mechanism according to this invention, with portions removed to facilitate viewing.
Figure 3:
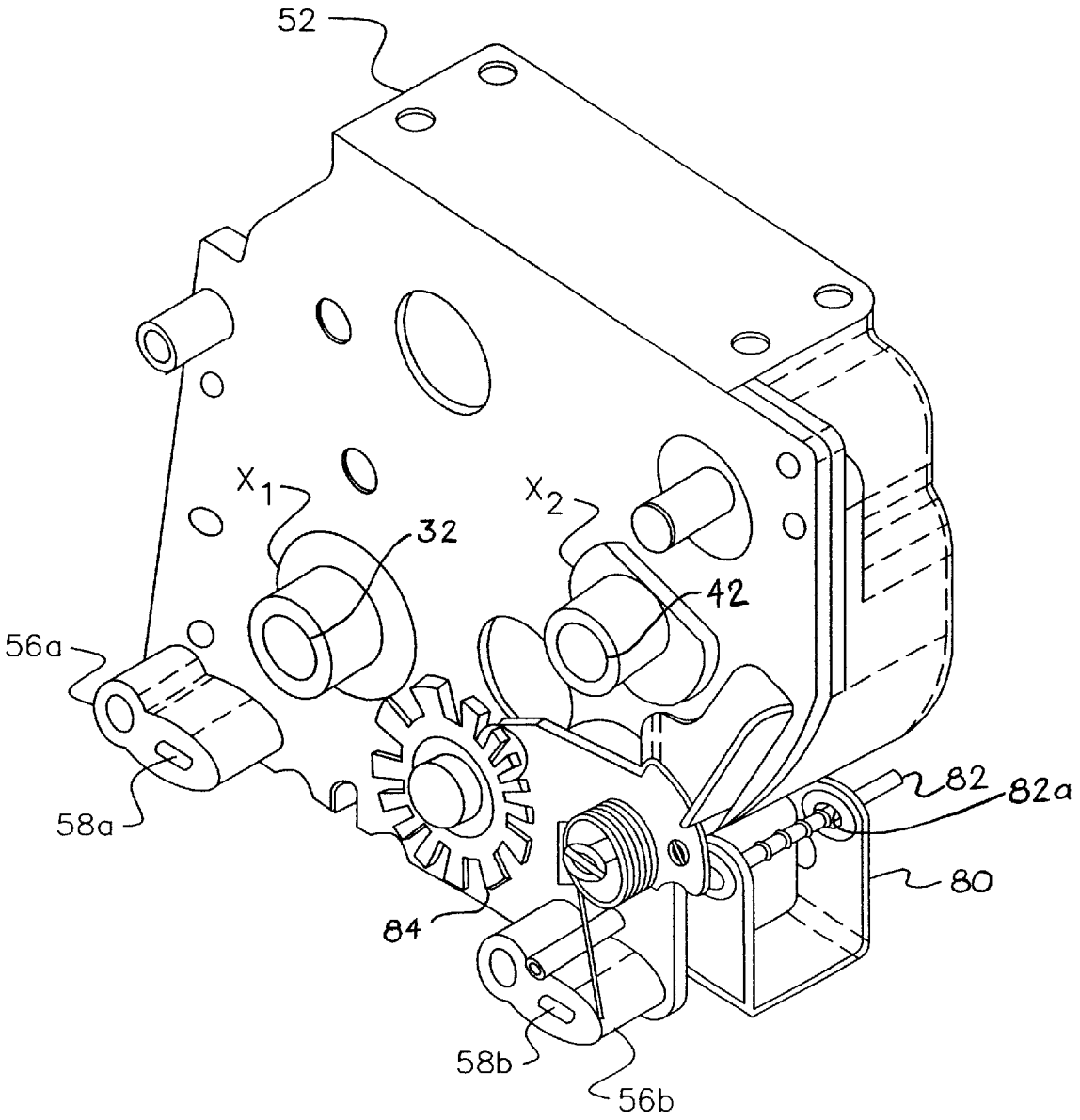
FIG. 3 is a view, in perspective and on an enlarged scale, of a gearbox assembly of the electrographic reproduction apparatus magnetic brush development station, as shown in FIG. 2, viewed from the interface with the development station housing.

Referring now to the accompanying drawings, FIG. 1 shows an exemplary electrographic reproduction apparatus development station, designated generally by the numeral 10, of the magnetic brush type. Although this development station is suitable for use with the invention described below, other development station configurations may similarly be employed. The magnetic brush development station 10 includes a housing 12 defining intercommunicating chamber-forming portions 12*a*–12*c,* including a lower portion 12*a* which serves as a reservoir for developer material D. The developer material is for example, a two-component material having magnetic carrier particles intermixed with relatively smaller pigmented marking particles. The upper portion 12*b* of the housing 12 contains a toning roller 14 for applying the marking particles to charge patterns formed on a dielectric support member 16 moving along a path P in juxtaposition to an opening O in the upper housing portion 12*b*.

The toning roller 14 of the magnetic brush development station 10 includes a core 18 having a plurality of magnets 20 spaced around the peripheral surface of the core. A non-magnetic substantially cylindrical shell 22 surrounds the core 18 and has its longitudinal axis offset from the longitudinal axis of the core. Such offset has the effect of decreasing the field strength of the magnets 20 over the area of the shell 22 spaced farther form the magnets so that the developer material has less propensity to adhere to the shell in that area and returns to the reservoir. As is well known in the art, the core and/or shell can be fixed or rotatable as long as the particular arrangement causes the developer material to move in the fields of the magnets 20 into contact with the dielectric member 16. In the particular toning roller 14 illustrated in FIG. 1, the core 18 (and the magnets 20) rotates clockwise, while the shell 22 rotates counterclockwise. A latent image charge pattern on the dielectric support member 16 attracts marking particles from the developer material into adhering relationship with the charge pattern to develop such pattern. The developed pattern can then be subsequently transferred to a final receiver sheet and fixed thereto by heat and/or pressure, or may be fixed directly on the dielectric member, to form a desired reproduction.

Developer material D within the reservoir formed by the housing portion 12*a* is stirred by a mixer assembly 24. The mixer assembly 24 is for example a ribbon blender. The ribbon blender includes an inner helical ribbon 28*a* and an outer helical ribbon 28*b* connected by means of rods 30 to a shaft 32. The shaft 32 is supported, as more fully described with reference to the invention as specified below, relative to the housing 12 for rotation about longitudinal axis of such shaft. The pitch of the respective ribbons 28*a,* 28*b* are of opposite hand, so that, as the shaft 32 rotates, the ribbons developer material is moved in opposite directions along the length of the blender and the material is agitated to provide a triboelectric charge which causes the marking particles to adhere to the carrier particles. Of course, other types of mixers, such as paddle wheels or augers for example, are suitable for use with this invention.

The mixer assembly 24 also moves developer material radially with respect to the mixer so that the material is moved into the portion of the housing 12 designated by the numeral 12*c*. A transporting mechanism 34 is located within the housing portion 12*c*. The mechanism 34 includes a plurality of pickup members 40 mounted on a shaft 42 for rotation therewith. The shaft 42 is supported, as more fully described with reference to the invention as specified below, relative to the housing 12 for rotation about longitudinal axis of such shaft. The pickup members 40 serve to transport developer material into the field of the magnets 20 of the toning roller 14. The pickup members 40 are for example in the general shape of buckets which, upon rotation of the shaft 42, are moved through the developer material where they pickup developer material. At that point in time when the pickup members 40 respectively pass the top dead center position for the mechanism 34, the developer material is urged by gravitational forces to fall from the pickup members. Since the falling developer material is in the magnetic field of the magnets 20 of the toning roller 14, the material is readily attracted to the shell 22 of the toning roller. The developer material is then moved by the toning roller 14 into applying relation with the charge pattern bearing dielectric support member 16 in the well known manner to develop a latent image charge pattern on such member.

As noted above, it has been found to be difficult to locate the mixer assembly of the electrographic reproduction apparatus magnetic brush development station in the reservoir of the development station, and to maintain the parallel alignrment between the drive shafts for the mixer assembly and the transport mechanism so as to assure optimum development efficiency for the development station. Accordingly, this invention provides an adjustment mechanism, designated generally by the numeral 50, to locate the drive shaft 32 for the ribbon blender of the mixer assembly 24 in a predetermined direction at a fixed distance from the interior wall of the reservoir portion 12*a* of the development station housing 12, and maintain the shaft 32 parallel to the shaft 42 of the transport mechanism 34. The adjustment mechanism 50 (see FIGS. 2–7) has been constructed so as to locate the ribbon blender of the mixer assembly 24 and buckets of the transport mechanism 34 assembly by using the accurate location of the gearbox 52 at the rear end 12*d* of the developer station housing 12, and the accurate location of a bearing cap assembly 54 at the front end 12*e* of the housing.

In order to accurately locate the gearbox 52 relative to the development station housing 12, two bushings 56*a,* 56*b* are provided extending from the gearbox. The gearbox 52 contains any suitable gear train (not shown) for transmitting an input drive I (see FIG. 2 or 4) to rotate output drives $X_1$ and $X_2$ (see FIG. 3) for the mixer assembly shaft 32 and the transport mechanism shaft 42 respectively. The bushings 56*a,* 56*b* respectively define two slots 58*a,* 58*b* (see FIG. 3). When the gearbox is operatively associated with the development station housing 12, the slots 58*a,* 58*b* are oriented in a predetermined direction (e.g., substantially horizontally), and respectively receive locating pins 60*a,* 60*b* extending from the end wall 12*d* of development station housing (see FIG. 4). The locating pins 60*a,* 60*b* are positioned in a preselected relation with the shaft 32 for the ribbons 28*a,* 28*b* of the ribbon blender of the mixer assembly 24. This enables the output drives $X_1$ and $X_2$ of the gearbox 52 to be connected to the shafts 32 and 42 to provide drive support for such shafts. Thereafter, the gearbox 52 can be adjusted in a corresponding direction (e.g., horizontally) to provide desired movement of the mixer assembly shaft 32 in order to adjust the ribbon blenders 28*a,* 28*b* relative to the interior wall of the development station housing reservoir portion 12*a* to achieve a predetermined distance or gap therebetween. The predetermined gap is selected so as to provide for optimum mixing efficiency in order to insure that marking particles are adequately scraped from the housing interior wall (i.e., prevented from building up on the interior wall surface), while making sure that the wall does not interfere with the rotation of the blender ribbons.

Figure 5:
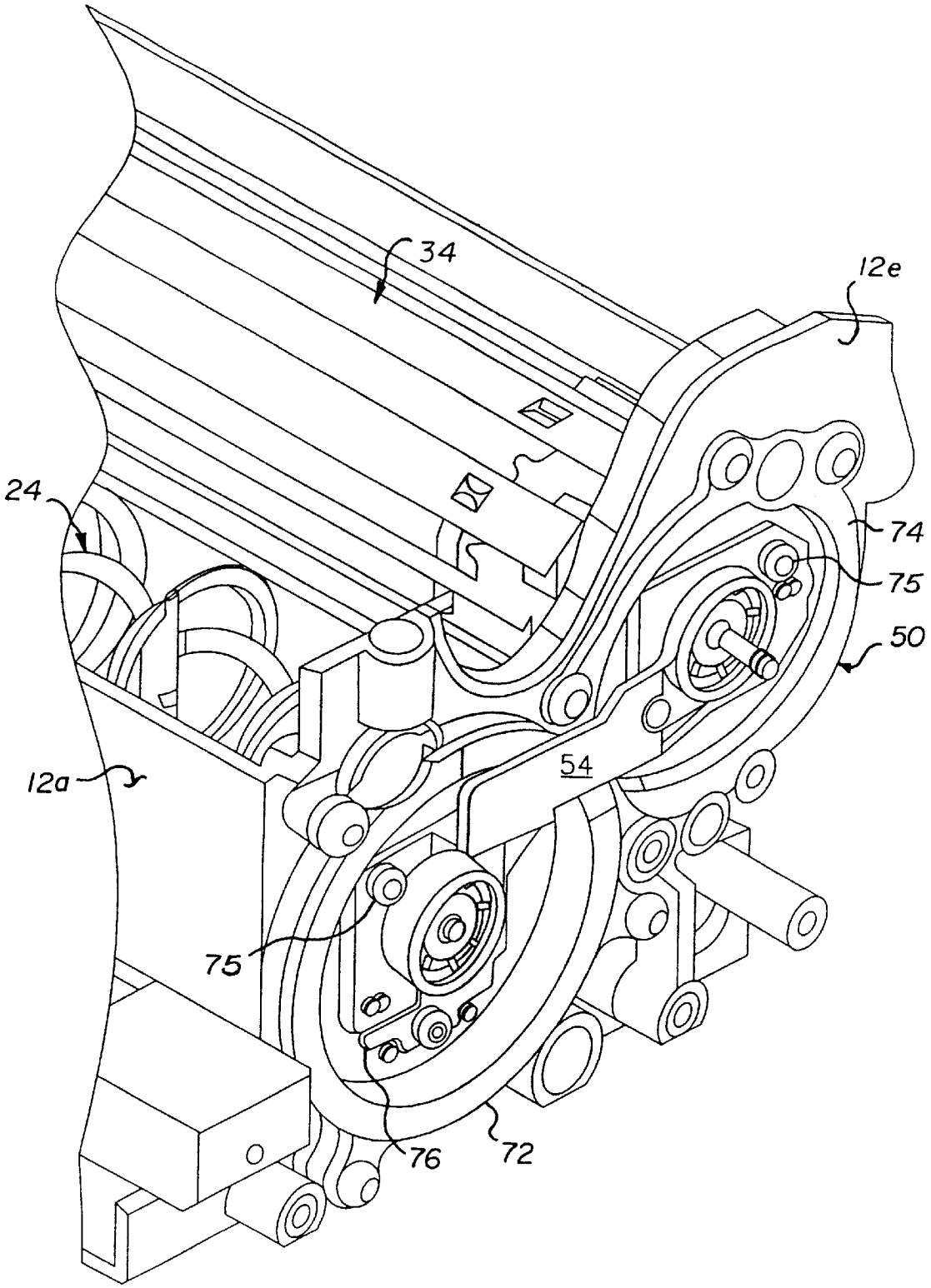
FIG. 5 is a view, in perspective and on an enlarged scale, of the electrographic reproduction apparatus magnetic brush development station and a portion of the adjustment mechanism according to this invention.
Figure 6:
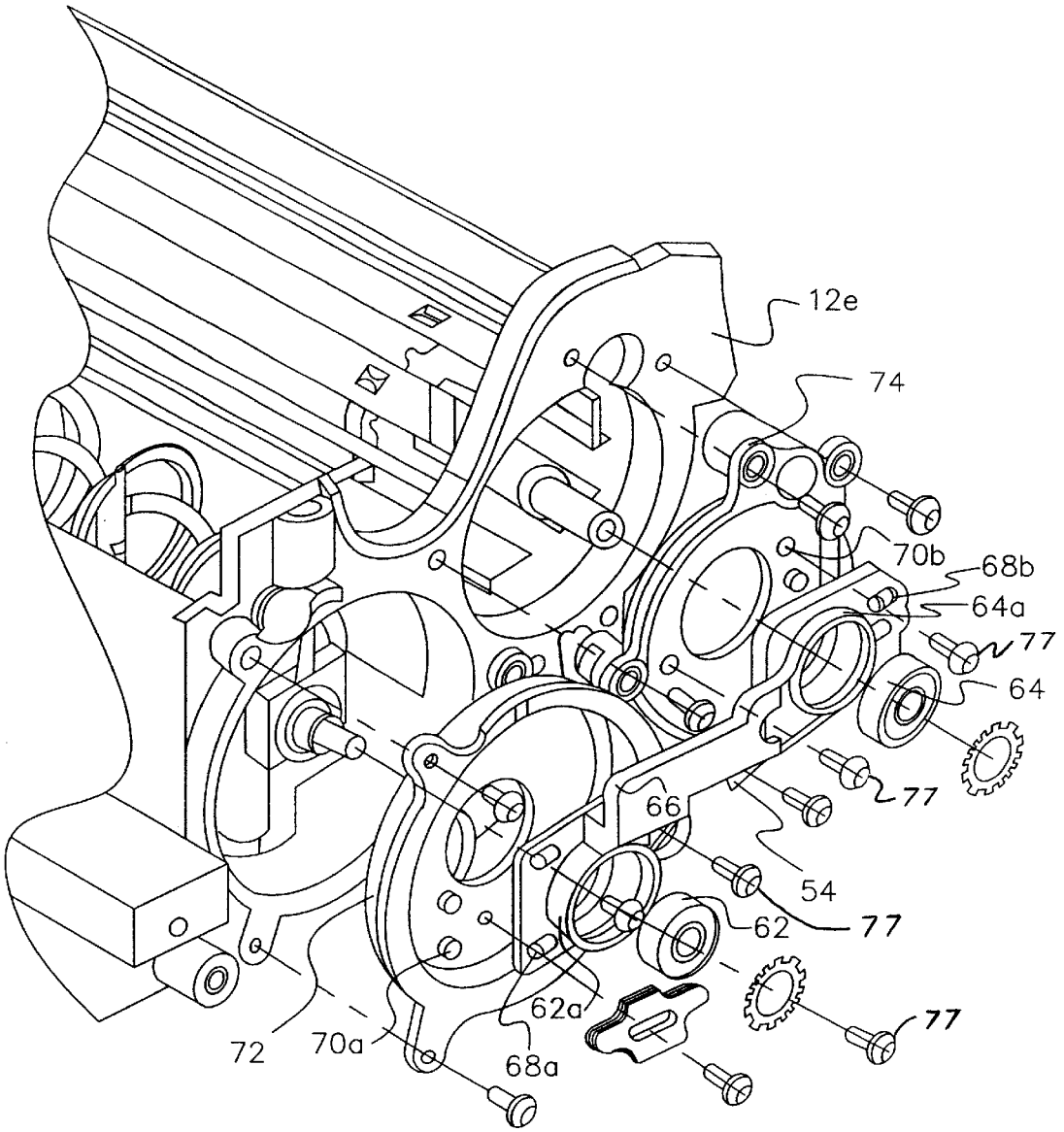
FIG. 6 is an exploded view, in perspective, of the electrographic reproduction apparatus magnetic brush development station and the portion of the adjustment mechanism as shown in FIG. 5.
Figure 7:
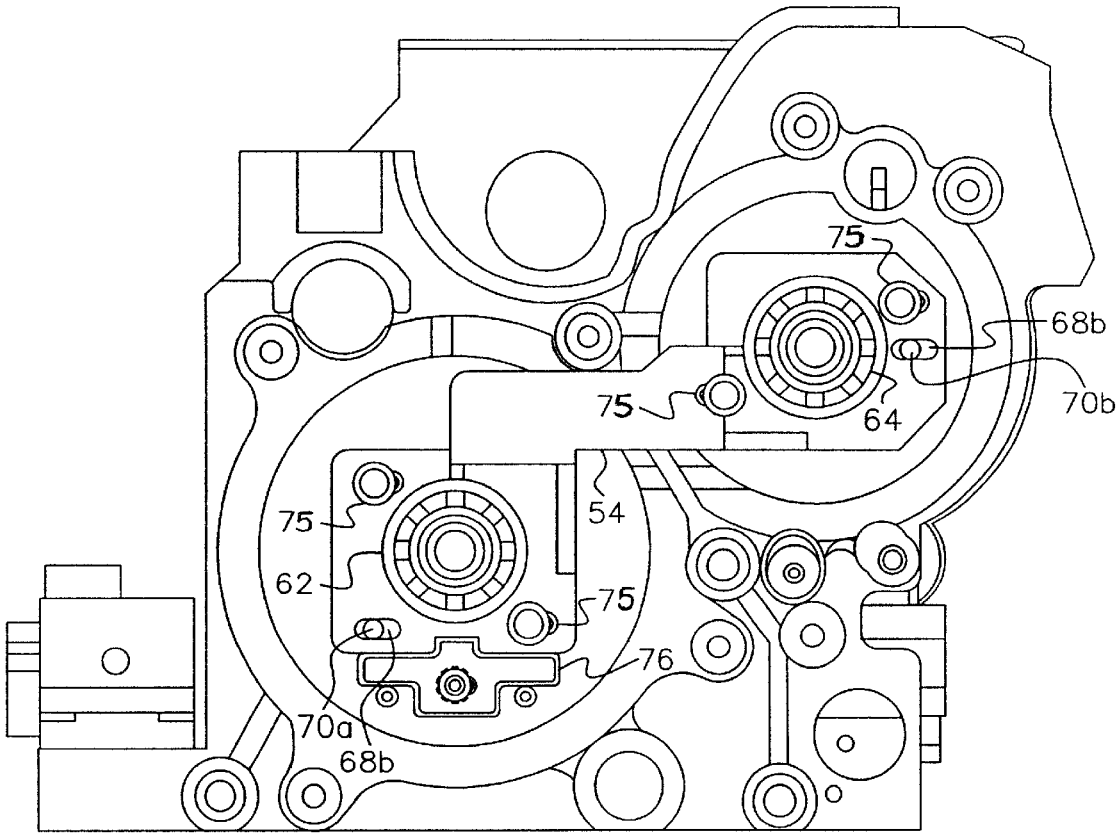
FIG. 7 is a front elevational view of the electrographic reproduction apparatus magnetic brush development station and the portion of the adjustment mechanism as shown in FIG. 5.

For accurately locating the bearing cap assembly 54 at the front of development station housing 12, two bearings 62, 64 are housed in the bearing cap assembly (best shown in FIGS. 5–7). The bearing cap assembly 54 includes a pair of bearing supports 62*a,* 64*a* for respectively supporting the bearings 62, 64. The bearings 62 and 64, in turn, respectively support ends of the shafts 32 and 42. A spacer member, such as for example an arm 66, rigidly connects the bearing supports 62*a,* 64*a*. The configuration of the spacer arm 66 is preselected to provide a set spacing between the bearing supports 62*a,* 64*a*. Thus, the longitudinal axes of the mixer assembly shaft 32 and the transport mechanism shaft 42 are maintained a fixed distance apart. The distances between the bearings 62, 64, along mutually perpendicular axes (e.g., horizontal and vertical axes), are matched to the same distances between the mixer assembly and transport mechanism output drives $X_1$ and $X_2$ in the gearbox 52 to keep the mixer assembly shaft 32 and the transport mechanism shaft 42 in parallel orientation.

The adjustment for the bearing cap assembly 54 is provided as follows. The bearing cap assembly 54 defines two slots 68*a,* 68*b*. Two pins 70*a,* 70*b* are respectively receivable within the two slots 68*a,* 68*b*. The pins 70*a,* 70*b* are respectively carried by a mixer end cap 72 and a transport mechanism end cap 74. The end caps 72, 74 are secured to the development station housing end wall 12*e,* by any suitable fastening mechanism, so as to substantially close the ends of the mixing zone and the material transport zone (see FIG. 6). The movement of the bearing cap assembly 54, by the relation of the pins 70*a,* 70*b* in the slots 68*a,* 68*b,* will enable limited movement of the shafts 32 and 42, such as along a substantially horizontal axis, for spatial adjustment thereof, but will prevent relative movement between the shafts, for example along a perpendicular axis, and will maintain the spacing between the shafts. Of course while the adjustment has been described with respect to the preferred embodiment as being substantially in a horizontal direction, adjustment relative to any desired axis may be accomplished with this invention.

Figure 4:
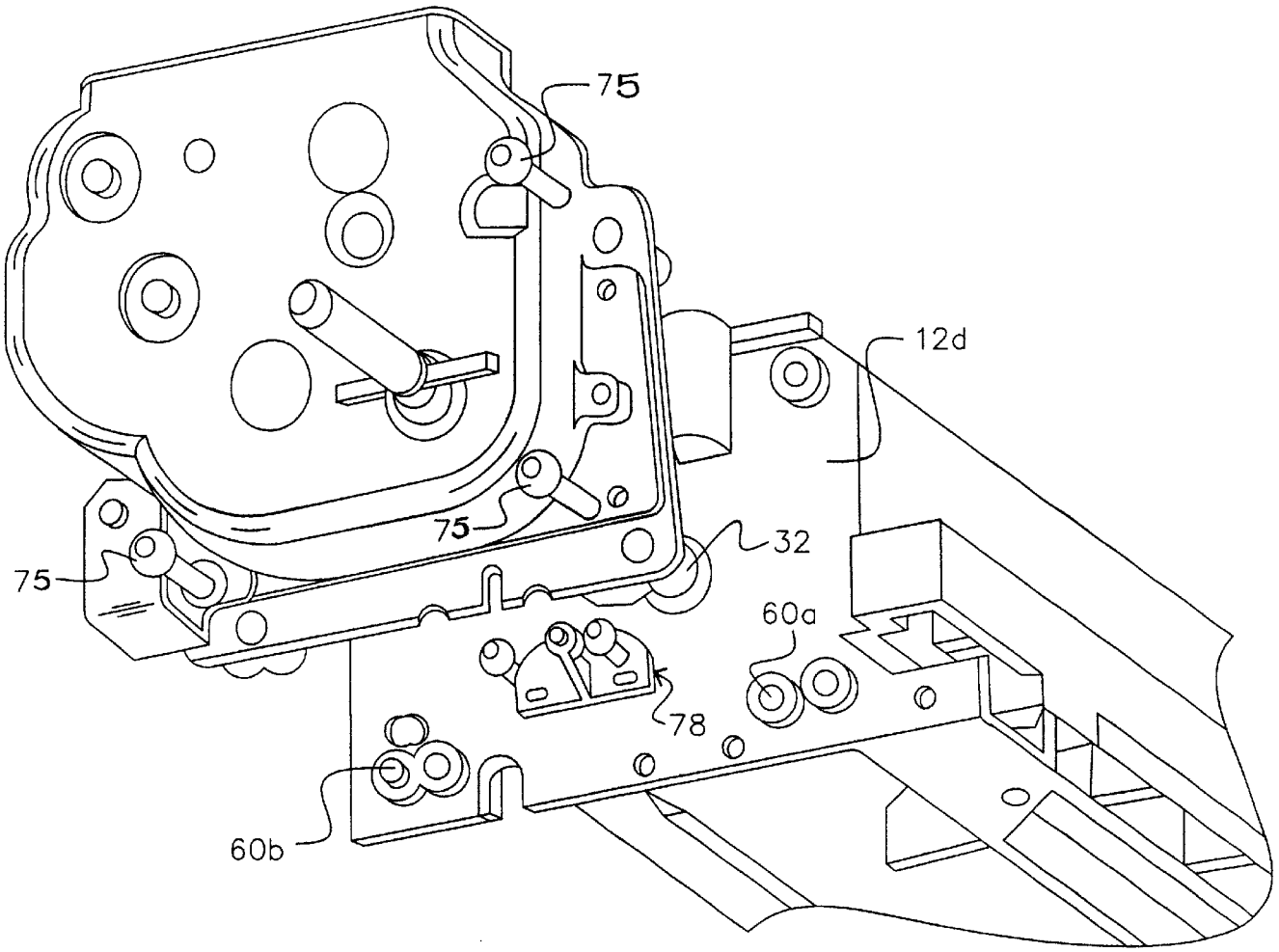
FIG. 4 is an exploded view, in perspective, of the gearbox assembly, as shown in FIG. 3, in relation with the interface with the development station housing.

Once the mixer shaft assembly is adjusted to provide the desired gap specification of the ribbon blender relative to the interior wall of the development station housing reservoir portion 12*a,* both in the front and back, the gearbox 52 is secured to the development station housing 12 with three screws 75 (see FIG. 4). Subsequently, the bearing cap assembly 54 is secured to the mixer end cap 72 and the transport mechanism end cap 74 with two screws 77 in each cap (see FIGS. 6 and 7).

Further, with the adjustment mechanism 50 according to this invention, two locks (or locators) 76, 78 are included, one in the front and one in the rear of the development station housing 12. The first lock 76 is positioned relative to the bearing cap assembly 54 (see FIG. 5) in the front of the development station housing 12, while the second lock 78 is positioned relative to the location of the gearbox 52 (see FIG. 4) at the rear of the development station housing. The locks are moved to respective locking positions after adjustment of the shafts 32 and 42 have been set-up, in the manner described above, and then secured with suitable fastener devices (see FIGS. 4 and 7) at substantially the same time. That is to say, when the bearing cap assembly 54 and the gearbox 52 and are precisely adjusted to the desired predetermined locations, they are secured by the locks to hold them permanently in place. With the locks 76, 78 secured in place, the gearbox 52 and bearing cap assembly 54 may be removed and reinstalled (or even replaced), with corresponding new assemblies located in the same position as the previously adjusted assemblies.

Additionally, a tensioner assembly 80 (see FIG. 3) has been shown as included with the gearbox 52 to eliminate slack in the drive chain 86 for the ribbon blender shaft 32 and transport mechanism shaft 42. Further, the gearbox 52 includes a plunger assembly 82 (also see FIG. 3). The plunger assembly 82 can be pushed through a hole 82*a* defined in the tensioner assembly 80 to keep a sprocket 84 from engaging the drive chain (not shown). This facilitates assembly of the gearbox with the developer station housing. Moreover, during operation of the development station housing, the plunger assembly 82 is actuated by a mechanical plate (not shown) associated with the mainframe of the reproduction apparatus to provide a positive stop for the tensioner assembly 80 ensuring that tension in the drive chain 86 is never lost.

With the adjustment mechanism 50 according to this invention, the desired ribbon blender to development station housing wall gap can be readily adjusted and set to a desired predetermined specification, with minimal variation, and the ribbon blender shaft assembly and the transport mechanism shaft assembly can be maintained parallel to one another.

The invention has been described in detail with particular reference to a preferred embodiment thereof, but it will be understood that variations and modifications can be effected within the spirit and scope of the invention.

What is claimed is:

1. In an electrographic reproduction apparatus development station including a housing, a rotatable mixer located in a developer material reservoir within said housing, a developer device for applying developer material to an electrostatic image to be developed, a rotatable transport mechanism for moving developer material from said reservoir to said developer device, and a drive mechanism for rotating said rotatable mixer, said rotatable transport mechanism, and said developer device, a mechanism for adjusting the location of said rotatable mixer and said rotatable transport mechanism within said development station housing, said adjustment mechanism comprising:

a first locating device for adjustably positioning said drive mechanism relative to said reservoir of said development station housing; and a second locating device for adjustably positioning said rotatable mixer and said rotatable transport mechanism relative to said development station housing, said second locating device including a spacer member for maintaining a predetermined fixed distance between said rotatable mixer and said rotatable transport mechanism.

2. The mechanism for adjusting the location of said rotatable mixer and said rotatable transport mechanism within said development station housing according to claim 1 wherein said first locating device includes at least one bushing extending from drive mechanism, said bushing defining a slot, and at least one pin extending from an end wall of development station housing, said pin being receivable in said slot, wherein when said drive mechanism is operatively associated with said development station housing, said slot is oriented in a predetermined direction so that said drive mechanism is adjustable relative to said development station housing in a corresponding direction.

3. The mechanism for adjusting the location of said rotatable mixer and said rotatable transport mechanism within said development station housing according to claim 1 wherein said first locating device includes a pair of bushings extending from drive mechanism, said bushings respectively defining a slot, and a pair of pins extending from an end wall of development station housing, said pins being receivable in said slots respectively, wherein when said drive mechanism is operatively associated with said development station housing, said slot is oriented in a predetermined direction so that said drive mechanism is adjustable relative to said development station housing in a corresponding direction.

4. The mechanism for adjusting the location of said rotatable mixer and said rotatable transport mechanism within said development station housing according to claim 3 wherein said first locating device further includes a locking mechanism attached to said development station housing and engaging said drive mechanism to lock said drive mechanism in relation to said development station housing after said drive mechanism is adjustably positioned relative thereto.

5. The mechanism for adjusting the location of said rotatable mixer and said rotatable transport mechanism within said development station housing according to claim 1 wherein said second locating device includes a first support for said rotatable mixer, and a second support for said rotatable transport mechanism, said spacer member connected between said first support and said second support, said first support and said second support respectively defining a slot, and a pair of pins extending from an end wall of development station housing, said pins being receivable in said slots respectively, wherein when said second locating device is operatively associated with said development station housing, said slots are oriented in a predetermined direction so that said rotatable mixer and said rotatable transport mechanism are adjustable, in tandem, relative to said development station housing in a corresponding direction.

6. The mechanism for adjusting the location of said rotatable mixer and said rotatable transport mechanism within said development station housing according to claim 5 wherein said second locating device further includes a locking mechanism attached to said development station housing and engaging said second locating device to lock said rotatable mixer and said rotatable transport mechanism in relation to said development station housing after said rotatable mixer and said rotatable transport mechanism are adjustably positioned relative thereto.

7. The mechanism for adjusting the location of said rotatable mixer and said rotatable transport mechanism within said development station housing according to claim 1 wherein said first locating device includes a pair of bushings extending from drive mechanism, said bushings respectively defining a slot, and a pair of pins extending from an end wall of development station housing, said pins being receivable in said slots respectively, wherein when said drive mechanism is operatively associated with said development station housing, said slots are oriented in a predetermined direction so that said drive mechanism is adjustable relative to said development station housing in a corresponding direction, and said second locating device includes a first support for said rotatable mixer, and a second support for said rotatable transport mechanism, said spacer member connected between said first support and said second support, said first support and said second support respectively defining a slot, and a pair of pins extending from an end wall of development station housing, said pins being receivable in said slots respectively, wherein when said second locating device is operatively associated with said development station housing, said slots are oriented in a predetermined direction so that said rotatable mixer and said rotatable transport mechanism are adjustable, in tandem, relative to said development station housing in a corresponding direction.

8. The mechanism for adjusting the location of said rotatable mixer and said rotatable transport mechanism within said development station housing according to claim 7 wherein said first locating device further includes a locking mechanism, and said second locating device further includes a locking mechanism.

9. The mechanism for adjusting the location of said rotatable mixer and said rotatable transport mechanism within said development station housing according to claim 7 wherein said first locating device further includes a locking mechanism attached to said development station housing and engaging said drive mechanism to lock said drive mechanism in relation to said developer station housing after said drive mechanism is adjustably positioned relative thereto, and said second locating device further includes a locking mechanism attached to said development station housing and engaging said second locating device to lock said rotatable mixer and said rotatable transport mechanism in relation to said development station housing after said rotatable mixer and said rotatable transport mechanism are adjustably positioned relative thereto.

10. An electrographic reproduction apparatus development station comprising:

a housing having walls defining an internal chamber, a portion of said chamber serving as a reservoir for developer material;

a mixer located in a developer material reservoir within said housing, said mixer including a ribbon blender mounted on a rotatable shaft;

a developer device for applying developer material to an electrostatic image to be developed;

a transport mechanism for moving developer material from said reservoir to said developer device, said transport mechanism including a plurality of buckets mounted on a rotatable shaft;

a drive mechanism for rotating said rotatable shaft of said mixer, said rotatable shaft of said transport mechanism, and said developer device; and a mechanism for adjusting the location of said rotatable shaft of said mixer and said rotatable shaft of said transport mechanism within said housing, said adjustment mechanism including a first locating device for adjustably positioning said drive mechanism relative to said reservoir of said development station housing, and a second locating device for adjustably positioning said rotatable mixer and said rotatable transport mechanism relative to said development station housing, said second locating device including a spacer member for maintaining a predetermined fixed distance between said rotatable mixer and said rotatable transport mechanism.

11. The mechanism for adjusting the location of said rotatable mixer and said rotatable transport mechanism within said development station housing according to claim 10 wherein said first locating device includes at least one bushing extending from drive mechanism, said bushing defining a slot, and at least one pin extending from an end wall of development station housing, said pin being receivable in said slot, wherein when said drive mechanism is operatively associated with said development station housing, said slot is oriented in a predetermined direction so that said drive mechanism is adjustable relative to said development station housing in a corresponding direction.

12. The mechanism for adjusting the location of said rotatable mixer and said rotatable transport mechanism within said development station housing according to claim 10 wherein said first locating device includes a pair of bushings extending from drive mechanism, said bushings respectively defining a slot, and a pair of pins extending from an end wall of development station housing, said pins being receivable in said slots respectively, wherein when said drive mechanism is operatively associated with said development station housing, said slots are oriented in a predetermined direction so that said drive mechanism is adjustable relative to said development station housing in a corresponding direction.

13. The mechanism for adjusting the location of said rotatable mixer and said rotatable transport mechanism within said development station housing according to claim 12 wherein said first locating device further includes a locking mechanism attached to said development station housing and engaging said drive mechanism to lock said drive mechanism in relation to said development station housing after said drive mechanism is adjustably positioned relative thereto.

14. The mechanism for adjusting the location of said rotatable mixer and said rotatable transport mechanism within said development station housing according to claim 10 wherein said second locating device includes a first support for said rotatable mixer, and a second support for said rotatable transport mechanism, said spacer member connected between said first support and said second support, said first support and said second support respectively defining a slot, and a pair of pins extending from an end wall of development station housing, said pins being receivable in said slots respectively, wherein when said second locating device is operatively associated with said development station housing, said slots are oriented substantially horizontally so that said rotatable mixer and said rotatable transport mechanism are horizontally adjustable, in tandem, relative to said development station housing.

15. The mechanism for adjusting the location of said rotatable mixer and said rotatable transport mechanism within said development station housing according to claim 14 wherein said second locating device further includes a locking mechanism attached to said development station housing and engaging said second locating device to lock said rotatable mixer and said rotatable transport mechanism in relation to said development station housing after said rotatable mixer and said rotatable transport mechanism are adjustably positioned relative thereto.

16. The mechanism for adjusting the location of said rotatable mixer and said rotatable transport mechanism within said development station housing according to claim 10 wherein said first locating device includes a pair of bushings extending from drive mechanism, said bushings respectively defining a slot, and a pair of pins extending from an end wall of development station housing, said pins being receivable in said slots respectively, wherein when said drive mechanism is operatively associated with said development station housing, said slots are oriented substantially horizontally so that said drive mechanism is horizontally adjustable relative to said development station housing, and said second locating device includes a first support for said rotatable mixer, and a second support for said rotatable transport mechanism, said spacer member connected between said first support and said second support, said first support and said second support respectively defining a slot, and a pair of pins extending from an end wall of development station housing, said pins being receivable in said slots respectively, wherein when said second locating device is operatively associated with said development station housing, said slots are oriented substantially horizontally so that said rotatable mixer and said rotatable transport mechanism are horizontally adjustable, in tandem, relative to said development station housing.

17. The mechanism for adjusting the location of said rotatable mixer and said rotatable transport mechanism within said development station housing according to claim 16 wherein said first locating device further includes a locking mechanism, and said second locating device further includes a locking mechanism.

18. The mechanism for adjusting the location of said rotatable mixer and said rotatable transport mechanism within said development station housing according to claim 16 wherein said first locating device further includes a locking mechanism attached to said development station housing and engaging said drive mechanism to lock said drive mechanism in relation to said development station housing after said drive mechanism is adjustably positioned relative thereto, and said second locating device further includes a locking mechanism attached to said development station housing and engaging said second locating device to lock said rotatable mixer and said rotatable transport mechanism in relation to said development station housing after said rotatable mixer and said rotatable transport mechanism are adjustably positioned relative thereto.

* * * * *